US007202825B2

(12) United States Patent
Leizerovich et al.

(10) Patent No.: US 7,202,825 B2
(45) Date of Patent: Apr. 10, 2007

(54) WIRELESS COMMUNICATION DEVICE WITH INTEGRATED BATTERY/ANTENNA SYSTEM

(75) Inventors: Gustavo D. Leizerovich, Aventura, FL (US); Donald W. Burnette, Sunrise, FL (US); Julio C. Castaneda, Coral Springs, FL (US); Orlando Gomez, Hialeah, FL (US)

(73) Assignee: Motorola, Inc., Schaumburg, IL (US)

( * ) Notice: Subject to any disclaimer, the term of this patent is extended or adjusted under 35 U.S.C. 154(b) by 49 days.

(21) Appl. No.: 11/227,011

(22) Filed: Sep. 15, 2005

(65) Prior Publication Data

US 2007/0057851 A1 Mar. 15, 2007

(51) Int. Cl.
*H01Q 1/24* (2006.01)

(52) U.S. Cl. ..... 343/702; 343/700 MS; 343/866

(58) Field of Classification Search ..... 343/702, 343/700 MS, 866, 867, 741, 742
See application file for complete search history.

(56) References Cited

U.S. PATENT DOCUMENTS 4,126,863 A 11/1978 Kolwaite
4,297,699 A 10/1981 Fowler et al.
5,181,025 A 1/1993 Ferguson et al.
5,265,158 A 11/1993 Tattari
6,072,993 A 6/2000 Trikha et al.
6,225,952 B1 * 5/2001 Harano ..... 343/702
6,700,491 B2 3/2004 Shafer
6,995,721 B2 * 2/2006 Furuki et al. ..... 343/702
7,088,294 B2 * 8/2006 Qi et al. ..... 343/702
2004/0217685 A1 11/2004 Park

FOREIGN PATENT DOCUMENTS

WO WO 2005/006579 1/2005

OTHER PUBLICATIONS

U.S. Appl. No. 11/216,776, filed Aug. 31, 2005, Kinezos et al.

* cited by examiner

*Primary Examiner*—Hoanganh Le

(57) ABSTRACT

A loop antenna (100) shares terminals with a thermistor on a battery. The battery (300) has at least two terminals (302 & 304) that connect to a thermistor (514). An electromagnetic wave radiating and receiving element (522) shares the at least two terminals (302 & 304) with the thermistor (514) but is electrically isolated from the thermistor (514) so that the thermistor (514) resistance can be measured while the electromagnetic wave radiating and receiving element (522) can communicate electrical RF signals via the at least two terminals with an RF circuit. A wireless communication device that uses the battery (300) and the loop antenna (100) is also disclosed.

20 Claims, 3 Drawing Sheets

WIRELESS COMMUNICATION DEVICE WITH INTEGRATED BATTERY/ANTENNA SYSTEM

CROSS-REFERENCE TO RELATED APPLICATION

The present patent application is related to co-pending and commonly owned U.S. patent application Ser. No. 11/227,367, entitled "WIRELESS COMMUNICATION DEVICE WITH INTEGRATED ANTENNA," filed on even date with the present patent application, the entire teachings of which being hereby incorporated by reference.

FIELD OF THE INVENTION

The present invention generally relates to the field of radio frequency antennas and more particularly to integrated near-field antennas.

BACKGROUND OF THE INVENTION

The progression of features and performance of portable wireless communications devices, such as cellular telephones, PDAs and the like, has occurred at an almost exponential rate since the devices were first introduced into the consumer market. Manufacturers are constantly working to reduce the size, extend battery life, and increase communication reliability and range. In addition, the devices now commonly have features such as picture, video, and sound recorders, organizers, synthesized ring tones, email and text messaging service, video games, and others.

Ironically, as phone manufacturers have worked to achieve longer and longer transmission distance capabilities, one new feature that can currently be found in some devices, but is being developed for more widespread use, is close-range data transferring capability. That is to say, it is desirable that the device is not able to send certain types of signals very far. One use of this feature can be, for instance, to communicate one's credit card information to complete a retail purchase. Ideal transmission in this mode is a very short distance, usually no more than four feet.

For this short-range transmission, an additional antenna is used. Preferably, this antenna will be conformal and not increase the size of the device package. Several manufactures have attempted to place the near-field antenna in the battery compartment or near the battery of the device. However, these prior-art solutions require additional terminals to connect and energize the antenna element, thereby necessitating that the device hardware be redesigned.

Those that have been able to use existing terminals require a complicated multiplexing scheme where use of the terminal is shared by time switching so that only one signal is present at a given time.

Therefore a need exists to overcome the problems with the prior art as discussed above.

SUMMARY OF THE INVENTION

Briefly, in accordance with the present invention, disclosed is a wireless communication circuit arrangement that includes a battery, a temperature sensing element, and an electromagnetic wave radiating and receiving element. The battery has two terminals and the temperature sensing element is thermally coupled to the battery. The temperature sensing element has a first end electrically coupled to the first terminal of the battery and a second end electrically coupled to the second terminal of the battery.

The electromagnetic wave radiating and receiving element is coupled to the battery terminals. Finally, the circuit arrangement includes a circuit portion that allows, at the battery terminals, a resistance of the temperature sensing device to be measured and simultaneously allows at least one of transmitted and received signals to be communicated by the electromagnetic wave radiating and receiving element.

An embodiment of the present invention also includes an inductive element for impeding radio frequency signals from passing through the temperature sensing element and is located between a first end of the temperature sensing element and a first terminal of the battery.

In an embodiment of the present invention, a capacitive element is included for impeding signals having a frequency less than about 13.5 MHz from passing through the electromagnetic wave radiating element. The capacitive element is provided between an end of the electromagnetic wave radiating and receiving element and a terminal of the battery.

In one embodiment, the electromagnetic wave radiating and receiving element comprises a loop antenna.

BRIEF DESCRIPTION OF THE DRAWINGS

The accompanying figures, where like reference numerals refer to identical or functionally similar elements throughout the separate views and which together with the detailed description below are incorporated in and form part of the specification, serve to further illustrate various embodiments and to explain various principles and advantages all in accordance with the present invention.

DETAILED DESCRIPTION

As required, detailed embodiments of the present invention are disclosed herein; however, it is to be understood that the disclosed embodiments are merely exemplary of the invention, which can be embodied in various forms as illustrated in the non-limiting exemplary embodiments of FIGS. 1–6. Therefore, specific structural and functional details disclosed herein are not to be interpreted as limiting, but merely as a basis for the claims and as a representative basis for teaching one skilled in the art to variously employ the present invention in virtually any appropriately detailed structure. Further, the terms and phrases used herein are not intended to be limiting; but rather, to provide an understandable description of the invention.

The terms "a" or "an", as used herein, are defined as one or more than one. The term plurality, as used herein, is defined as two or more than two. The term another, as used herein, is defined as at least a second or more. The terms including and/or having, as used herein, are defined as comprising (i.e., open language). The term coupled, as used herein, is defined as connected, although not necessarily directly, and not necessarily mechanically.

Wireless communication is well known to those having ordinary skill in the art and is accomplished through use of a radio connected to an electromagnetic radiating and receiving element, or antenna. An antenna is an impedance-matching device used to absorb or radiate electromagnetic waves into or from free space. The function of the antenna is to "match" the impedance of the propagating medium, which is usually air, to the radio frequency (RF) signal source. Radio signals include voice communication channels, data link channels, and navigation signals.

One specific commonly-used type of antenna is a "loop" antenna. A loop antenna is "closed-circuit" antenna. That is, one in which a conductor is formed into one or more turns so that its two ends are close together. A current is then passed through the conductor, which has inductive properties, causing an electromagnetic wave to be radiated. These types of antennas are well known to those of ordinary skill in the art. Although the name seems to imply that the antenna shape is round, loop antennas may take many different forms, such as rectangular, square, triangle, ellipse, and many others.

Figure 1:
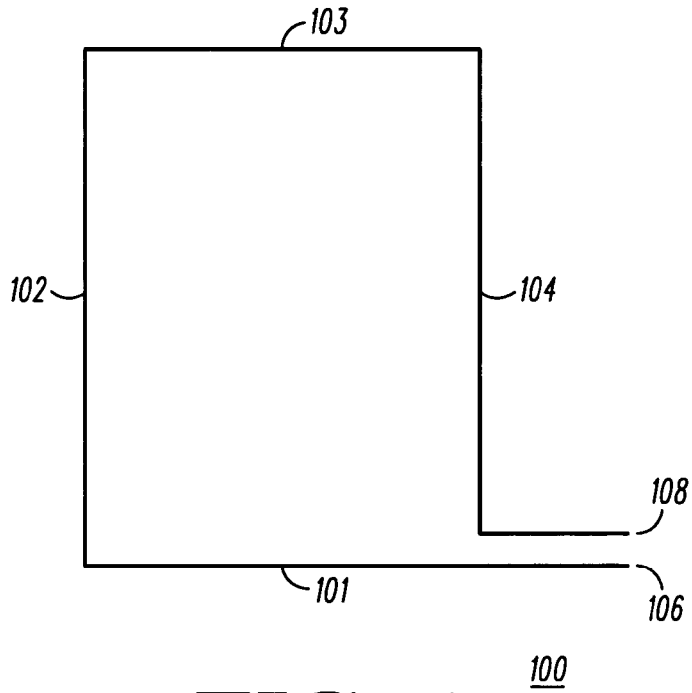
FIG. 1 is an aerial view of a loop antenna suitable for use in an embodiment of the present invention.

One embodiment of a loop antenna 100, in accordance with the present invention, is shown in FIG. 1. The antenna 100, as shown, is rectangular in shape and includes four sides 101, 102, 103, & 104 conductively connected and forming a loop. In the illustrated embodiment, the opposing sides 101 and 103 and 102 and 104 are of equal length and substantially parallel to each other. However, the antenna is not restricted to any particular shape. In some embodiments, the loop includes multiple turns. In the exemplary embodiment, the loops are all coplanar, but this is not a necessity.

The loop antenna 100 also includes two feed points 106 and 108. Feed point 106 is an extension of side 101 and feed point 108 is an extension of side 104. Feed points 106 and 108 are isolated from each other and are used to energize the loop with RF signals.

A small loop (circular or square) is equivalent to a small magnetic dipole whose axis is perpendicular to the plane of the loop. In other words, the electromagnetic fields radiated or received by an electrically small circular or square loop is similar to those fields radiated by a small dipole antenna. Dipoles are well known in the art.

Figure 2:
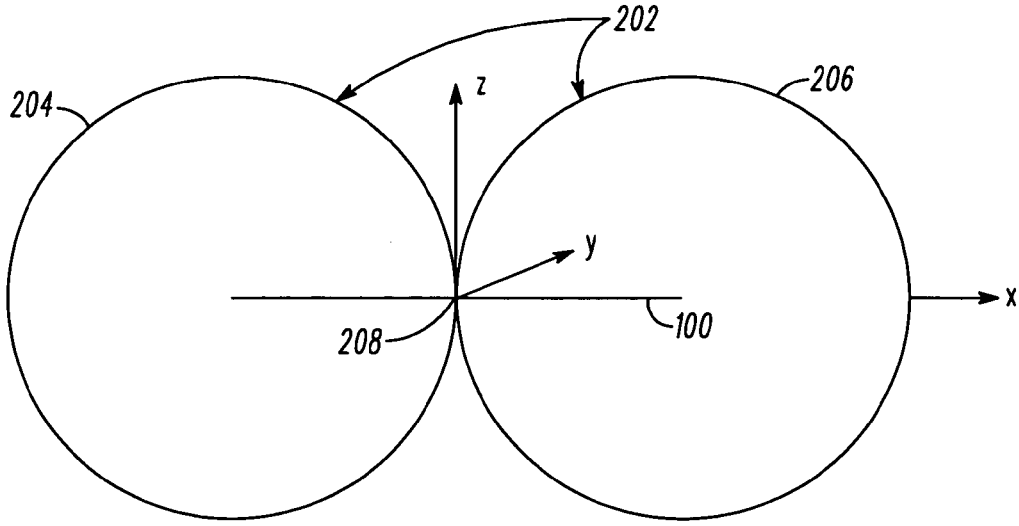
FIG. 2 is an illustration of a radiation pattern of the loop antenna of FIG. 1.

FIG. 2 illustrates an exemplary radiation pattern produced by the exemplary loop antenna of FIG. 1. In the illustration, the loop antenna 100 is shown from a side view, where the conductive length of the antenna element lies along a single plane, shown as a straight, horizontally-oriented line. Emitted from the loop antenna 100 is a radiation pattern 202, that, from the side view shown, resembles two adjacent circles 204 and 206 with an edge of each circle intersecting the antenna 100 at a center point 208. The circles represent radiating electromagnetic waves traveling through space. In a three dimensional view, the radiation pattern 202 resembles a doughnut shape, where the circles 204 and 206 come out of the page and connect to each other to form one continuous set of radiated waves.

Axes x, y, and z are shown in FIG. 2. The radiation pattern is substantially uniform along the x-y plane. A "null" occurs along the z axis, where little or no signal is radiated. As is shown by the illustrated circular patterns 202 and 204, as one moves from directly on the z axis toward a plane defined by the x and y axes, the radiation field of the antenna is entered into and radiation strength increases until maximum reception is reached along the x, y plane.

A loop is considered "small" when the current distribution in the loop is the same as in a coil. That is, the current is in the same phase and has the same amplitude in every part of the loop. To meet this condition, the total length of the conductor in the loop should not exceed about 0.08 of a wavelength.

Loop antennas with electrically small circumferences or perimeters have small radiation resistances that are usually smaller than their loss resistances. As a result, loop antennas with electrically small circumferences or perimeters are very poor radiators and are able to communicate only short distances. For this reason, a small loop antenna is well suited for what is referred to as "near field communication" (NFC).

Near field communication, or NFC, refers to communication that is transmitted and received in close proximity to a second transceiver, i.e., short range communication, regardless of protocol or standards used. Near field communication includes use of any suitable antenna for short range communication, such as, and without limitation, for effecting financial card transactions and the like, as should be obvious to those of ordinary skill in the art in view of the discussion in this specification.

As an example, near field communication, or NFC, is often transferred at a frequency of about 13.5 MHz, but other frequencies can be used as well. It is contemplated that the near field communication, or NFC, mode of the present invention complies with all types of short range communication standards, such as either ECMA-340 or ECMA-352 Near Field Communication Interface and Protocol standards, however, the invention is not so limited. The near field communication, or NFC, can also encompass other standards, such as ISO 14443 (proximity) and ISO 15963 (vicinity) for example, and also other frequencies or ranges of frequencies as should be obvious to those of ordinary skill in the art in view of the present discussion.

This type of communication is typically used for low power, low data rate applications, such as electronic identification or other information exchange transactions. In an embodiment of the present invention, for example and not for any limitation of the scope of alternatives, the maximum communication range is typically less than one foot (~4 inches). For example, credit card information can be exchanged between a wireless device and a vendor. In this type of transaction, it is desirable not to send this private information to a range that can be received by those in the vicinity.

Figure 3:
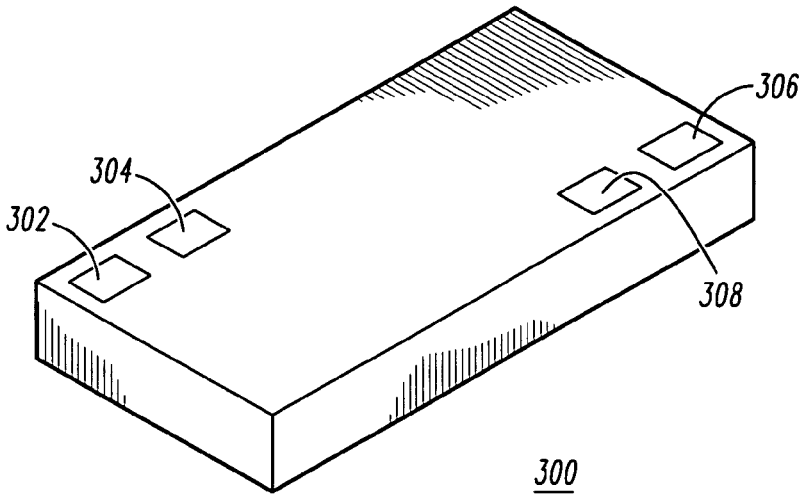
FIG. 3 illustrates a battery suitable for use in an embodiment of the present invention.

Referring now to FIG. 3, a battery 300 is shown. The battery provides power for operation of a portable communication device, such as that shown in FIG. 4. The battery 300 is illustrated as a rectangular object, but in practice, batteries are available in many different shapes and sizes and the invention is not limited to any particular shape or size. All batteries have terminals for supplying power. In the illustrated battery 300, two electrical terminals 302 and 304 are adjacent one another. The terminals include conductive surfaces suitable for making contact with terminals within a device, such as the portable communication device shown in FIG. 4, when the battery is placed against the device in a proper orientation.

Figure 4:
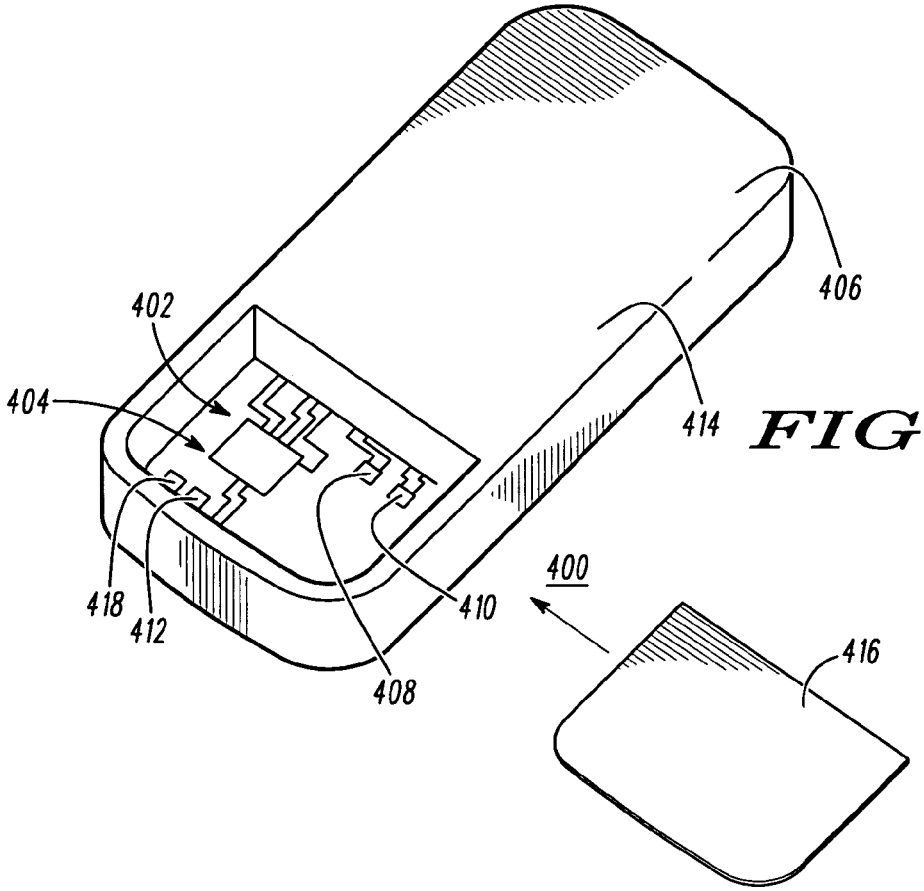
FIG. 4 is a top-back isometric view of a portable communication device, according an embodiment of the present invention.

FIG. 4 illustrates a top-back isometric view of a portable communication device or other wireless communication device, such as a cellular phone 400, with its back 414 showing and its back cover 416 removed, according to an exemplary embodiment of the present invention. The top-back view illustrates the exemplary cellular phone 400, with a battery compartment 402, and internal circuits 404 of the cellular phone 400. The exemplary cellular phone 400 has a case 406 that is constructed of molded, non-conductive plastic in the exemplary embodiment. The exemplary cellular phone 400 further includes a set of battery contact points 408 and 410 for electrically coupling the terminals 302 and 304 of the battery 300 to the phone 400. Again, the contacts shown are merely exemplary, the contacts can be located anywhere that correspond to the terminals on a battery, such as the battery 300 shown in FIG. 3, and the invention is not limited to the embodiment shown in FIG. 4.

To be useful for day-to-day continuous use, a battery should be rechargeable. However, particular charging methods differ, depending on the particular battery type and composition. For instance, some batteries are charged at a constant voltage level until a full charge is received by the battery. Other charging schemes charge the battery in pulses according to a battery charging curve. To ensure that a particular battery is charged properly, some manufacturers provide an electrically erasable programmable read-only memory (EEPROM) on the battery. The battery manufacturer places charging information into the EEPROM, which is later read so that the optimal battery-charging scheme is followed. To access this EEPROM, at least one additional terminal is added to the battery.

A second feature present on most batteries is a thermistor. A thermistor is a temperature-sensing element, whereby its resistance varies with temperature. By placing a thermistor directly on the battery, it is possible to monitor the temperature of the battery and adjust charging and/or operating cycles accordingly. For example, if the battery is in an extremely cold environment, it may damage the battery to charge it very quickly, thereby causing a sudden rapid heat gain. As another example, if the battery is overly heated, damage may be caused by further charging, and charging may be slowed or stopped until the battery returns to a normal operating temperature. Generally, the thermistor requires a separate terminal on the battery.

Referring back to FIG. 3, two additional terminals 306 and 308 are shown on the battery 300. These additional terminals represent the additional terminals used to couple the EEPROM and the thermistor to the phone 400.

Figure 5:
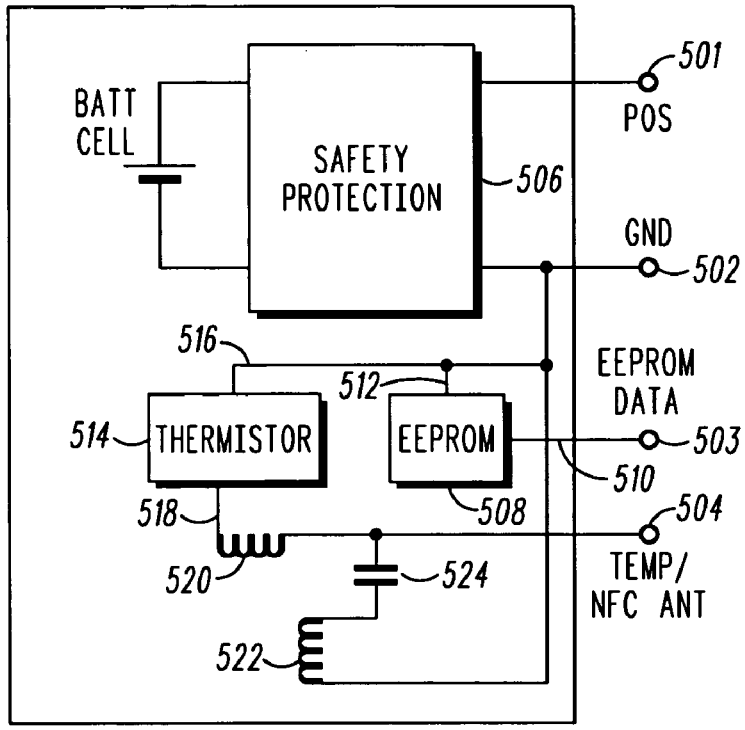
FIG. 5 is a schematic diagram of an antenna/battery combination, according to an exemplary embodiment of the present invention.

FIG. 5 shows a schematic of a battery having four terminals 501–504. Terminals 501 and 502 correspond to terminals 302 and 304 as shown in FIG. 3 and described above. The terminals 501 and 502 are used to receive DC voltage from the battery or, conversely, to charge the battery. Terminal 502 is a ground terminal and, as will be explained, is shared by other battery resources.

Also shown in FIG. 5 is safety protection circuit (shown as a block) 506. The safety protection circuit 506 is used to protect the battery against overvoltages or overly-fast discharges caused by, for instance, short circuits.

An EEPROM 508 has two leads 510 and 512. Lead 510 electrically couples the EEPROM to terminal 503 of the battery and lead 512 electrically couples the EEPROM to the ground terminal 502. The EEPROM can be read from and written to by applying voltages between the terminals 502 and 503.

Additionally, a thermistor 514 is shown in the schematic of FIG. 5. The thermistor 514 is a resistive element that has two leads 516 and 518. The first lead 516 is connected to the ground terminal 502. The second lead 518 is coupled to terminal 504 through an RF choke 520. RF choke 520 is a highly inductive element that prevents high-frequency signals from passing through the thermistor 514. The RF choke 520 electrically appears as an open circuit to these signals, while electrically appearing as a short circuit to DC signals, such as those used to measure the resistance of the thermistor 514. RF chokes are well know to those of ordinary skill in the art.

Also shown in the schematic of FIG. 5 is an NFC antenna 522. Advantageously, the NFC antenna 522 is implemented on the existing battery circuit without the need for any additional separate terminals. Because the NFC antenna 522 is a loop antenna in structure, the antenna is represented in the schematic as an inductor. As can be seen, the NFC antenna 522 shares the ground terminal 502 and the thermistor terminal 504.

To provide frequency isolation to the thermistor circuit, a capacitive element 524 is placed between the NFC antenna 522 and the terminal 504, at the side of the RF choke 520 opposite the thermistor 514. The capacitive element 524 electrically appears as an open circuit to DC and low frequency signals and, therefore, does not adversely affect the thermistor circuit. To higher frequency signals, the capacitive element 524 is virtually invisible and electrically appears as a short circuit. Due to the RF choke 520 and the capacitive element 524, both NFC signals and DC signals can exist in the same place at the same time without interfering with each other, thereby avoiding the need for multiplexing.

Figure 6:
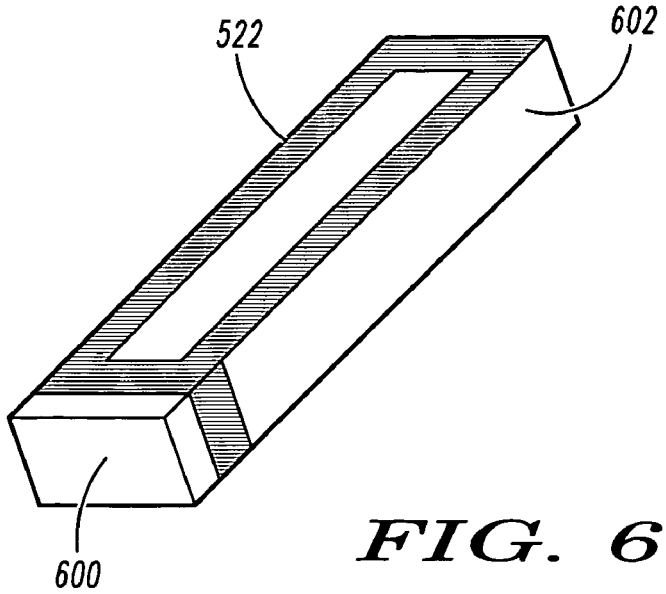
FIG. 6 is a view of an antenna/battery combination, according to an exemplary embodiment of the present invention.

FIG. 6 illustrates the inventive antenna 522 attached to a battery 600. Referring briefly back to FIGS. 3 and 4, it can be seen that once the battery is installed in the phone 400, one surface of the battery is very close to the outer surface of the phone. By placing the antenna 522 on a top surface of the battery, as shown in FIG. 6, the antenna 522 is advantageously placed directly between the battery and the outer cover and is therefore, very close to the outer surface of the phone 400. In this configuration, impedance caused by the materials, such as the housing 414, of the phone 400 is reduced and the antenna is better able to radiate and/or receive electromagnetic waves.

In addition to being near the outer surface of the phone 400, batteries are usually of significant size with reference to the phone dimensions. Therefore, the battery also provides an adequate surface area to place the antenna. In one embodiment of the present invention, the antenna is an integral part of the battery. In this embodiment, the antenna can comprise a wire attached to the battery or can be implemented in a flexible circuit board mounted on the battery cell. To minimize the effects of the battery cell on the antenna, a high permeability element, for instance, a ferrite film, can be place between the antenna and the battery. The ferrite material acts as a conduit for the magnetic flux lines for the antenna and minimizes electromagnetic waves from entering the battery and from resulting in unwanted reflections and losses. Other metallic shielding materials can also be used without departing from the spirit of the invention as understood by those of ordinary skill in the art in view of the present discussion.

In an embodiment of the present invention, the antenna 522 is placed on a sleeve 602 that can be moved from battery to battery. This embodiment saves cost by not requiring every battery to be manufactured with extra antenna materials. In yet another embodiment, the antenna can be embedded in a portion of the non-conductive cover 406 of the phone 400, such as the back 414 or the battery cover 416, shown in FIG. 4.

The phone 406 is provided with an RF circuit module and controller circuits, generally shown in FIG. 4 as part of the internal circuits 404. The RF circuit module of the exemplary embodiment has an RF contact and a ground contact that provide an RF connection interface used to couple RF signals between the RF circuit module and the loop antenna. Referring again to FIG. 4, in an embodiment of the present invention, the RF connection and ground is made at a set of terminals 418 and 412 in the phone body. The terminals 418 and 412 are the same terminals used for the thermistor, i.e., terminals 504 and 502.

The phone 400 is also provided with a circuit for measuring the resistance of the thermistor. Temperature states of the battery can be determined by these resistance values. Because of the inductive element, i.e., RF choke 520 and the capacitive element, i.e., capacitor 524, the thermistor resistance can be measured at the same time RF signals are being communicated using the antenna 522.

According to alternative embodiments of the present invention, the loop antenna may be used for reception of RF signals that are received and coupled from the loop antenna to the RF circuit module, or for transmission of RF signals that are coupled from the RF circuit module to loop antenna, or both.

As has been described, the present invention includes a loop antenna that adds NFC functionality to a wireless communication device without the requirement of additional terminals on the device for connection to the antenna. The antenna element is advantageously placed on or near the outer surface of the device's battery, thereby utilizing very little space in the device. Inductive and capacitive elements provided in the circuit allow the antenna and a temperature sensing device to coexist and continuously function without interfering with each other. Therefore, each element appears to have exclusive use of the same terminals.

Although specific embodiments of the invention have been disclosed, those having ordinary skill in the art will understand that changes can be made to the specific embodiments without departing from the spirit and scope of the invention. The scope of the invention is not to be restricted, therefore, to the specific embodiments, and it is intended that the appended claims cover any and all such applications, modifications, and embodiments within the scope of the present invention.

For example, while the thermistor circuit is shown in the present example, other circuits can have signals that co-exist with the RF signals of the NFC loop antenna circuit as should be obvious to those of ordinary skill in the art in view of the present discussion. As an example, a different type of temperature sensor circuit could share the terminals, such as terminals 502 and 504, on the battery with the NFC antenna.

It should be noted that, although an NFC antenna has been described herein, other frequencies may be used and are within the spirit and scope of the present invention.

What is claimed is:

1. A wireless communication circuit arrangement comprising:

a battery having at least a first terminal and a second terminal;

a temperature sensing element thermally coupled to the battery, the temperature sensing element having a first end electrically coupled to the first terminal of the battery and a second end electrically coupled to the second terminal of the battery;

an electromagnetic wave radiating and receiving element having a first end and a second end, the first end electrically coupled to the first terminal of the battery and the second end electrically coupled to the second terminal of the battery; and a circuit that allows at the first terminal and the second terminal a resistance of the temperature sensing device to be measured and simultaneously allows at least one of transmitted and received signals to be communicated between the electromagnetic wave radiating and receiving element and the first terminal and the second terminal.

2. The circuit arrangement according claim 1, further comprising:

an inductive element for impeding radio frequency signals from passing through the temperature sensing element, the inductive element provided between the first end of the temperature sensing element and the first terminal of the battery.

3. The circuit arrangement according claim 1, further comprising:

a capacitive element for impeding signals having a frequency less than about 13.5 MHz from passing through the electromagnetic wave radiating element, the capacitive element provided between the first end of the electromagnetic wave radiating and receiving element and the first terminal of the battery.

4. The circuit arrangement according to claim 1, wherein the electromagnetic wave radiating and receiving element comprises a loop antenna.

5. The circuit arrangement according to claim 1, wherein the electromagnetic wave radiating and receiving element is an integral part of the battery.

6. The circuit arrangement according to claim 1, further comprising:

a high magnetic permeability element provided between the electromagnetic wave radiating and receiving element and the battery, the high magnetic permeability element providing a path to the magnetic flux lines to avoid losses through the battery.

7. The wireless communication circuit arrangement according to claim 1, wherein the circuit arrangement is part of a communications device.

8. The circuit arrangement according to claim 1, wherein all radiating and receiving portions of the electromagnetic wave radiating and receiving element are coplanar.

9. The circuit arrangement according to claim 1, wherein the electromagnetic wave radiating and receiving element comprises a near field communication antenna.

10. A radio communication device comprising:

a circuit board including at least one of an RF transmission circuit and an RF receiving circuit, both electrically coupled with a first terminal and a second terminal of the circuit board;

a battery having at least a first terminal and a second terminal, the first terminal of the battery being removably coupled to the first terminal of the circuit board and the second terminal of the battery being removably coupled to the second terminal of the circuit board;

a temperature sensing element thermally coupled to the battery, the temperature sensing element having a first contact electrically coupled to the first terminal of the battery and a second contact electrically coupled to the second terminal of the battery;

an electromagnetic wave radiating and receiving element having a first end and a second end, the first end electrically coupled to the first terminal of the battery and the second end electrically coupled to the second terminal of the battery; and a resistance measuring circuit electrically coupled to the first terminal and the second terminal, the resistance measuring circuit measures a resistance of the temperature sensing element while the circuit board is at least one of transmitting and receiving radio signals using the electromagnetic wave radiating and receiving element.

11. The radio communication device according claim 10, further comprising:

an inductive element for impeding radio frequency signals from passing through the temperature sensing element, the inductive element provided between the first end of the temperature sensing element and the first terminal of the battery.

12. The radio communication device according to claim 10, further comprising:

a capacitive element for impeding signals having a frequency less than about 13.5 MHz from passing through the electromagnetic wave radiating and receiving element, the capacitive element provided between the first end of the electromagnetic wave radiating and receiving element and the first terminal of the battery.

13. The radio communication device according to claim 10, wherein the electromagnetic wave radiating and receiving element comprises a loop antenna.

14. The radio communication device according to claim 10, wherein the electromagnetic wave radiating and receiving element is an integral part of the battery.

15. The radio communication device according to claim 10, further comprising:

a high magnetic permeability element provided between the electromagnetic wave radiating and receiving element and the battery.

16. The radio communication device according to claim 15, wherein the high magnetic permeability element is at least partially made of ferrite.

17. The radio communication device according to claim 10, wherein all radiating and receiving portions of the electromagnetic wave radiating and receiving element are coplanar.

18. The radio communication device according to claim 10, further comprising:

a body enclosing at least the circuit board and the battery, wherein the electromagnetic wave radiating and receiving element is embedded in the body.

19. The circuit arrangement according to claim 10, wherein the electromagnetic wave radiating and receiving element comprises a near field communication antenna.

20. A wireless communication circuit arrangement comprising:

a battery having at least a first terminal and a second terminal;

a temperature sensing element thermally coupled to the battery, the temperature sensing element having a first end electrically coupled to the first terminal of the battery and a second end electrically coupled to the second terminal of the battery;

a short range communication loop antenna having a first end and a second end, the first end electrically coupled to the first terminal of the battery and the second end electrically coupled to the second terminal of the battery; and a circuit that allows at the first terminal and the second terminal a resistance of the temperature sensing device to be measured and simultaneously allows at least one of transmitted and received signals to be communicated between the short range communication loop antenna and the first terminal and the second terminal.

* * * * *